United States Patent [19]

Sakai

[11] 3,954,352

[45] May 4, 1976

[54] DIAPHRAGM VACUUM PUMP

[75] Inventor: Toshimitsu Sakai, Toyota, Japan

[73] Assignee: Toyota Jidosha Kogyo Kabushiki Kaisha, Toyota, Japan

[22] Filed: Oct. 10, 1973

[21] Appl. No.: 405,175

[30] Foreign Application Priority Data

Nov. 13, 1972 Japan ..... 47-113687

[52] U.S. Cl. ..... 417/244; 417/470

[51] Int. Cl.[2] ..... F04B 45/04; F04B 3/00

[58] Field of Search ..... 417/470, 471, 254, 267, 417/534–536, 521, 244

[56] References Cited

UNITED STATES PATENTS

| | | | |
|---|---|---|---|
| 2,189,526 | 2/1940 | Babitch | 417/470 |
| 2,631,538 | 3/1953 | Johnson | 417/244 |
| 2,798,662 | 7/1957 | Evans | 417/244 |
| 3,035,676 | 5/1962 | Nallinger | 417/470 |
| 3,045,896 | 7/1962 | Compton et al. | 417/521 |
| 3,186,349 | 6/1965 | Compton et al. | 417/470 |
| 3,252,424 | 5/1966 | Johnson et al. | 417/471 |
| 3,298,321 | 1/1967 | Reifel | 417/471 |
| R14,029 | 12/1915 | Schiodt | 417/244 |
| R25,849 | 9/1965 | Smith | 417/244 |

*Primary Examiner*—William L. Freeh

*Attorney, Agent, or Firm*—Stevens, Davis, Miller & Mosher

[57] ABSTRACT

A diaphragm vacuum pump, which comprises a first and a second pressure reduction chambers respectively at the both faces of the spring loaded diaphragm piston assembly of the pump. The first and second chambers are respectively connected with a pneumatically operated device and the atmosphere and connected to each other, suction and discharge of the air in the first chamber being conducted in an opposite cycle against those in the second chamber to subsequently produce vacuum of a high degree by the reciprocation of the diaphragm piston assembly.

4 Claims, 4 Drawing Figures

DIAPHRAGM VACUUM PUMP

BACKGROUND OF THE INVENTION

The present invention relates to a diaphragm vacuum pump, and more particularly to a diaphragm vacuum pump to be driven by the prime engine of a vehicle for supplying vacuum to pneumatically operated devices equipped within the vehicle.

SUMMARY OF THE INVENTION

The prime object of the present invention is to provide a diaphragm vacuum pump driven by the prime engine of the vehicle, wherein the pump function to produce enough vacuum in a short period of time to actuate pneumatically operated devices installed within the vehicle.

Another object of the present invention is to provide a diaphragm vacuum pump, wherein the pump is provided with a first and a second pressure reduction chambers respectively at the both faces of the spring loaded diaphragm piston assembly of the pump; the first and second chambers are respectively connected with a pneumatically operated device and the atmosphere and are connected to each other, suction and discharge of the air in the first chamber being conducted in an opposite cycle against those in the second chamber to subsequently produce high vacuum by the reciprocation of the diaphragm piston assembly.

A further object of the present invention is to provide a diaphragm vacuum pump, having the above-mentioned characteristics, wherein the biasing direction of the resilient means loaded on the diaphragm piston may be reversed in necessity to minimize unnecessary torque loss of the prime engine and wearing of the diaphragm piston assembly.

Still further object of the present invention is to provide a diaphragm vacuum pump, having the above-mentioned characteristics, wherein the connection between the first and the second chambers may be reversed in necessity to minimize unnecessary torque loss of the prime engine and wearing of the diaphragm piston assembly.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
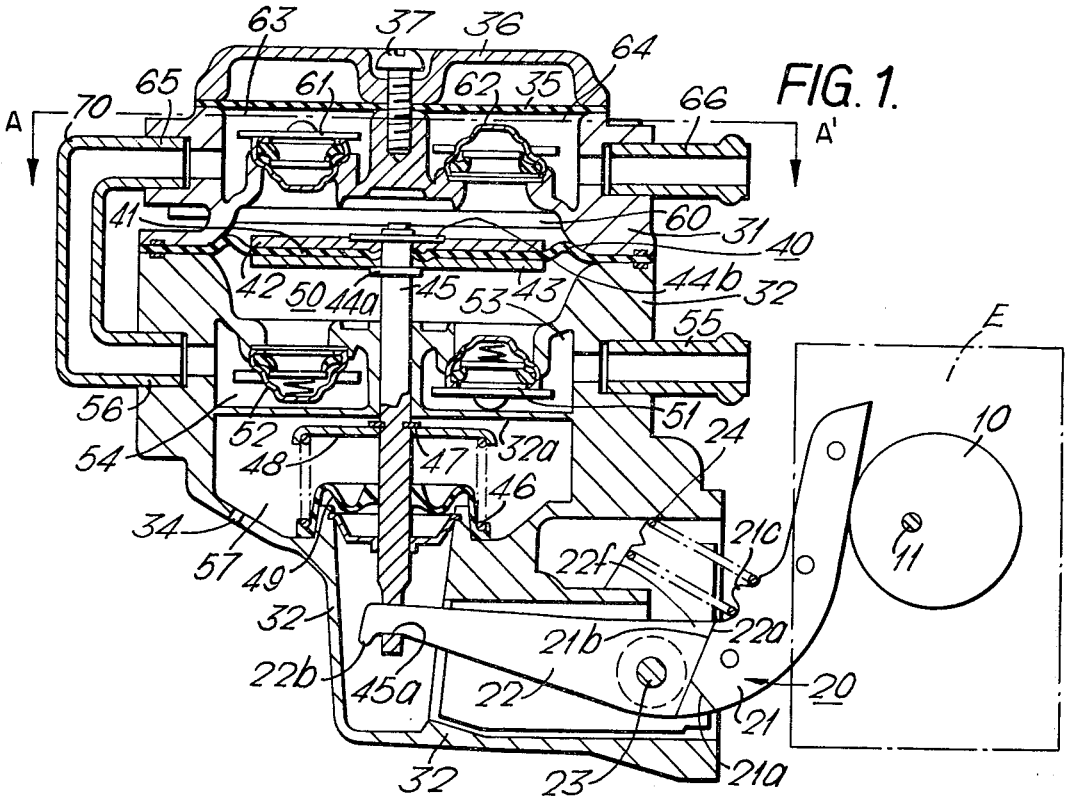
FIG. 1 shows a view of an elevational cross-section of a diaphragm vacuum pump in accordance with the present invention.

Now for more details, reference is made to the accompanying drawings wherein FIG. 1 gives an example of a preferred embodiment of a diaphragm vacuum pump in accordance with the present invention. The vacuum pump has hollow housing substantially comprising a cover section 36, an upper housing section 31 and a lower housing section 32. This vacuum pump is in operative connection with a pump driving mechanism including an eccentric cam 10, which is firmly mounted on a pump drive shaft 11 driven by the prime engine E of a vehicle. The pump driving mechanism further includes a rocker arm 20 comprising a drive arm 21 and an interlocking arm 22.

The drive arm 21 engages at its one end with the engagement face of the eccentric cam 10 for engine torque transmission. At the other end, the drive arm 21 is journalled by a pivot pin 23 on the inside wall of the lower housing section 32 so that the drive arm 21 is only vertically swingable. Provided on the inner face of the other end of the drive arm 21 is a recess **21*a* and an engagement portion 21*b*. A compression coil spring 24 is disposed between the inner wall of the lower housing section 32 and a boss 21*c* provided substantially at the center portion of the drive arm 21**.

The interlocking arm 22 has at its base end a fork portion **22*f* which is pivoted by the pivot pin 23 co-axially with the drive arm 21. Thus, the end face 22*a* of the base end is engageable with the engagement portion 21*b* of the drive arm 21. The top end of the interlocking arm 22 is formed into a hook 22*b* which is engaged in an engagement through hole 45*a* provided at the lower portion of an operation rod 45 of a diaphragm piston assembly 40 of the vacuum pump, so that the downward thrusting force of the drive arm 21 can only be transmitted to the operation rod 45**.

The diaphragm piston assembly 40 comprises a circular diaphragm 41, the annular outer rim of which is pneumatically hermetically held between the annular joint faces of the upper and lower housing sections 31 and 32. The piston assembly 40 further includes the operation rod 45 of which the top portion is connected with the center of the diaphragm 41 by means of circular clips **44*a* and 44*b* through plate members 42 and 43**.

Below the diaphragm piston assembly 40, provided is a coil spring 46 for constantly biasing the operation rod 45 upwardly against the downward thrusting force of the rocker arm 20. This spring 46 is interposed between the bottom face of a circular retainer 48 locked on the operation rod 45 by means of a circular clip 47 and the upper face of the annular rim of a seal member 49 mounted on the inner wall of the lower housing section 32.

The diaphragm piston assembly 40 divides the interior of the housing into two or upper and lower sections. In the lower section, formed is a first pressure reduction chamber 50 which is connected with a first suction chamber 53 and a first discharge chamber 54 respectively through a first suction check valve 51 and a first discharge check valve 52. The first suction chamber 53 includes a port 55 connected to a vacuum cylinder of, for instance, a brake booster of the vehicle not shown in the figure. The first discharge chamber 54 is provided with a port 56 connected to a second suction chamber 63 for a second pressure reduction chamber 60 which will be discussed in detail later. Below the first pressure reduction chamber 50, an atmospheric chamber 57 is formed by a partition wall **32*a* of the lower housing section 32 and the seal member 49. This atmospheric chamber 57 is in constant communication with the atmospheric air through a communication hole 34 drilled through the side wall of the lower housing section 32**.

Figure 4:
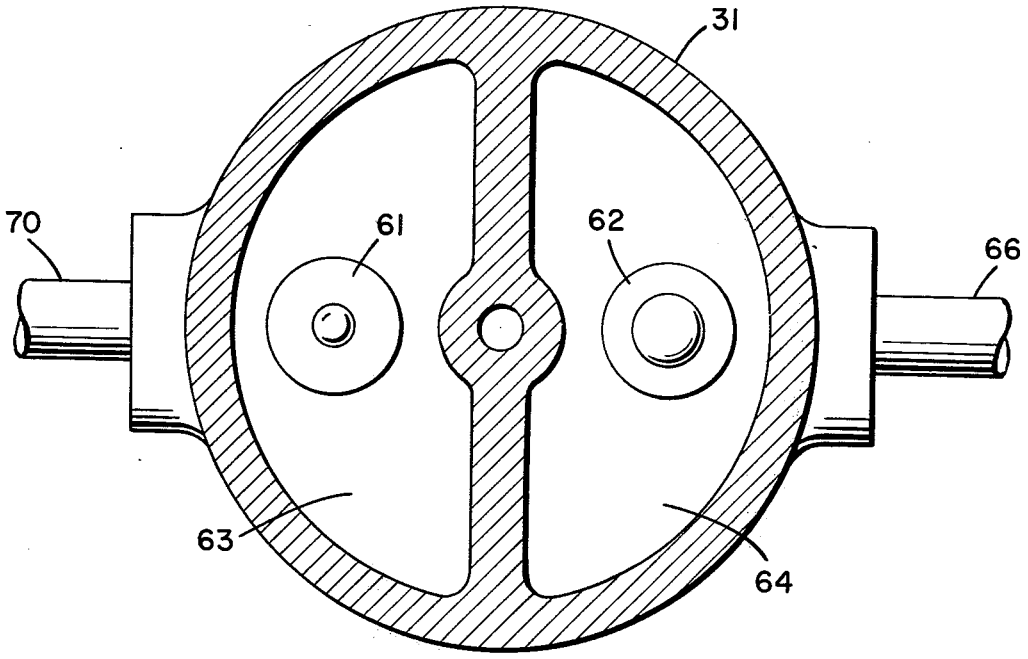
FIG. 4 is a cross-sectional view along the line A—A' in FIG. 1.

Referring to FIG. 4 as well FIG. 1, the second pressure reduction chamber 60 is provided within the upper section of the housing interior. This second pressure reduction chamber 60 is communicated with the second suction chamber 63 and a second discharge chamber 64 respectively through a second suction check valve 61 and a second discharge check valve 62. The second suction chamber 63 includes a port 65 which is connected to the port 56 of the first discharge chamber 54 by a communication conduit 70. The second discharge chamber 64 opens through a port 66 to the atmospheric air or to the intake-manifold (not shown in the figure) of the prime engine E. These second suction and discharge chambers 63 and 64 are pneumatically hermetic to each other by way of an seal member 35 interposed between the joint faces of the cover section 36 and the upper housing section 31, the cover section 36 being fastened on the upper housing section 31 by a fastening screw 37. FIG. 4 illustrates the upper surface or joint face of housing 31 which, in cooperation with the seal member 35, forms the separate chambers 63 and 64 which are hermetic to each other. As is apparent from FIG. 1, the chambers 50 and 60 are symmetrical, that is, they substantially correspond in size, shape, and relative position of the valves 51, 52, and 61,62 on opposite sides of the diaphragm 41.

Hereinafter the operation of the diaphragm vacuum pump having the above-disclosed construction will be described. When the prime engine E rotates the eccentric cam 10 through the drive shaft 11, the drive arm 21 of the rocker arm 20 swings with a fulcrum of the pivot pin 23 by its engagement with the cam face of the eccentric cam 10 and the biasing force of the spring 24. Counterclockwise swing of the drive arm 21 causes counterclockwise swing of the interlocking arm 22 by way of engagement between the engagement portion 21*b* of the drive arm 21 and the end face 22*a* of the interlocking arm 22. This displaces the operation rod 45 of the diaphragm piston assembly 40 downward against the resilient force of the spring 46. While the drive arm 21 swings clockwise, the interlocking arm 22 swings clockwise by the returning force of the spring 46 by way of the operation rod 45.

The diaphragm piston assembly 40 reciprocates vertically by the described swinging movement of the rocker arm 20. In the reciprocation, while the diaphragm piston assembly 40 makes its upward movement from its lower dead point, the first suction check valve 51 opens to lead the air from the port 55 into the first pressure reduction chamber 50 through the first suction chamber 53, the first discharge check valve 52 being kept closed. Meanwhile, simultaneously in the second pressure reduction chamber 60, the second suction check valve 61 is kept closed and the second discharge check valve 62 opens to discharge the air inside the second pressure reduction chamber 60 outward through the second discharge chamber 64 and the port 66.

While the diaphragm piston assembly 40 makes its downward movement from its upper dead point, the first suction check valve 51 is kept closed and the first discharge check valve 52 opens to discharge the air previously sucked into the first pressure reduction chamber 50. The discharged air is led into the second suction chamber 63 through the first discharge chamber 54, the port 56, the communication conduit 70 and the port 65. At the same time, in the second pressure reduction chamber 60, the second discharge check valve 62 is kept closed and the second suction check valve 61 opens to lead the air supplied into the second suction chamber 63 toward the second pressure reduction chamber 60.

Figure 2:
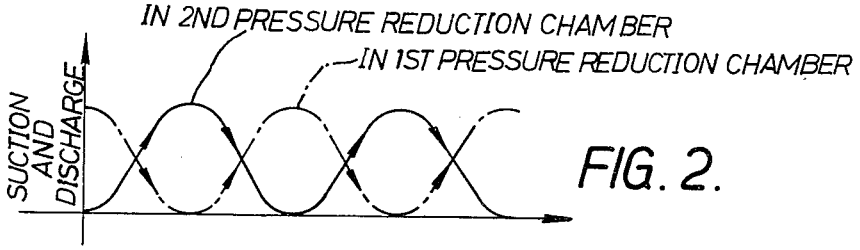
FIG. 2 illustrates the phases of the suction and discharge operation in the first and second pressure reduction chambers of the diaphragm vacuum pump shown in FIG. 1.

With the above-embodied diaphragm vacuum pump, the suction and discharge processes are carried in relatively opposite cycles between the first and second pressure reduction chambers 50 and 60. A series of the described operation cycles of relative suction and discharge is well illustrated in the operation characteristic curves in FIG. 2. In FIG. 2, clearly observed is a 180° displacement between the phases of the suction and discharge processes respectively in the first and second pressure reduction chambers 50 and 60. This enables the disclosed vacuum pump to produce a higher degree of vacuum than the conventional pumps of the same and similar types. Furthermore, the negative pressure can be increased much faster.

When the negative pressure within the first pressure reduction chamber 50 is increased toward a predetermined one, the suction check valve 51 will be kept closed until the negative pressure value within the first pressure reduction chamber 50 exceeds that within the vacuum cylinder. And the second pressure reduction chamber 60 communicates with the atmosphere in its discharge process by way of the second discharge check valve 62. The big pressure difference between the first and second pressure reduction chambers 50 and 60 pushes the diaphragm piston assembly 40 downwardly in the lowered position against the resilient force of the spring 46. And the diaphragm piston assembly 40 is reciprocated by the rocker arm 20 while being pushed downwardly to the mentioned lowered position. Thus, the diaphragm piston assembly 40 is not actuated unnecessarily and the life of the diaphragm 41 is prolonged.

The experiments conducted by the inventor proves that when the displacement of the suction and discharge phases between the first and second pressure reduction chambers 50 and 60 is set to take approximately 45° to 90°, the speed of the increase of the negative pressure is slower and the obtainable degree of vacuum is lower than by the disclosed embodiment with the 180° phase displacement.

The above-embodied diaphragm vacuum pump can be operated differently by connecting the first suction chamber 53 of the first pressure reduction chamber 50 to the second discharge chamber 64 of the second pressure reduction chamber 60 by way of a communication conduit, the port 65 of the second suction chamber 63 being connected to the vacuum cylinder. In this instance, the first and second pressure reduction chambers 50 and 60 take respectively the role of the second and first pressure reduction chambers described heretofore.

With this modified embodiment, when the negative pressure within the second pressure reduction chamber 60 is increased toward the predetermined value, the first pressure reduction chamber 50 attains with the atmospheric pressure in the downward movement of the diaphragm piston assembly 40. The pressure difference between the first and second pressure reduction chambers 50 and 60 pushes the diaphragm piston assembly 40 upward. Furthermore, the resilient force of the spring 46 works additionally to push the diaphragm piston assembly 40 upward. This reciprocates the diaphragm piston assembly 40 by the rocker arm 20 against the high vacuum within the second pressure reduction chamber 60 to make a higher degree of vacuum obtainable.

Figure 3:
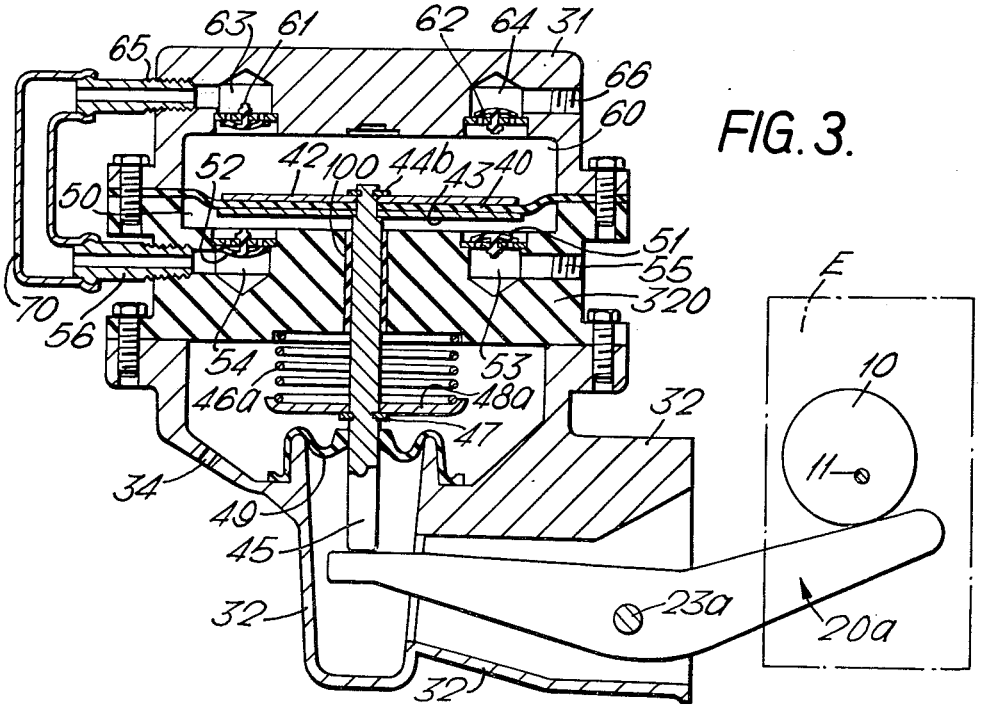
FIG. 3 shows a view of an elevational cross-section of another embodiment of a diaphragm vacuum pump in accordance with the present invention.

FIG. 3 illustrates a second preferred embodiment of the present invention, wherein the same and/or similar component parts and portions are indicated by the same and/or similar reference numerals and characters as in the first preferred embodimemt. Constructive differences in the second preferred embodiment from the first one is represented by a coil spring 46*a* interposed between the bottom face of a partition member 320 and the upper face of an annular retainer 48*a* locked on the operation rod 45 by means of circular clip 47. This spring 46*a* biases the operation rod 45 constantly downward. A rocker arm 20*a* is formed integrally and journalled on the inner wall of the lower housing section 32 by a pivot pin 23*a*. One end of the rocker arm 20*a* engages with the cam face of the eccentric cam 10 and the other end detachably with the bottom face of the operation rod 45. The partition member 320 includes a sleeve 100 made of synthetic resin such as polytetrafluoroethylene to receive therein the frictional portion of the operation rod 45 so as to minimize possible leakage of the vacuum pressure. Again, as in the embodiment of FIG. 1, the chambers 50 and 60 are symmetrical.

The operation of the second preferred embodiment is such that when the eccentric cam 10 rotates, the rocker arm 20*a* is swung with a fulcrum of the pivot pin 23*a* by way of engagement between the arm 20*a* and the cam face of the cam 10 and the biasing force of the spring 46*a*. The swinging movement of the rocker arm 20*a* reciprocates the diaphragm piston assembly 40 by way of the operation rod 45. Then, through the same operation processes as described in the first preferred embodiment, a big pressure difference is produced between the first and second pressure reduction chambers 50 and 60. This pressure difference and the downward biasing force of the spring 46*a* act to push the diaphragm piston assembly 40 downward. This enables the reciprocation of the diaphragm piston assembly 40 by the rocker arm 20*a* even after a high degree of vacuum is obtained within the first pressure reduction chamber 50. Subsequently, a higher degree of vacuum can be obtained within the first pressure reduction chamber 50.

As in the case of the first preferred embodiment, the reverse communication between the first and second pressure reduction chambers 50 and 60 is applicable in this second preferred embodiment. In this instance, the operation features are same as in the case of the first embodiment and the pressure difference between the first and second pressure reduction chambers 50 and 60 pushes the diaphragm piston assembly 40 upward against the downward biasing force of the spring 46*a*. Subsequently, the reciprocation of the diaphragm piston assembly 40 can be adjusted and regulated by proper selection of resilient force of the spring 46*a*.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. In a diaphragm vacuum pump for a vehicle, comprising:

a pump housing mounted on a body portion of the vehicle and including thereon an inlet port connected to a pneumatically operated device and an exhaust port connected to the atmosphere;

a diaphragm piston assembly hermetically assembled within said housing to form a first and a second pressure reduction chambers respectively at the faces thereof, said first and second chambers being connected respectively with said inlet and exhaust port;

a first valve means assembled within said first chamber and including a first suction valve to pass air from said pneumatically operated device into said first chamber through said inlet port and a first exhaust valve to a discharge said air into said second chamber;

a second valve means assembled within said second chamber and including a second suction valve to pass air exhausted from said first chamber into said second chamber by way of said first exhaust valve and a second exhaust valve to discharge said air externally, the suction and discharge of said second valve means being conducted in an opposite cycle to the suction and discharge of said first valve means;

a communication means for providing pneumatic communication between said first and second chambers by conducting the air exhausted by said first exhaust valve to said second suction valve;

an operation rod for reciprocating said diaphragm piston assembly for subsequently producing vacuum in said first and second pressure reduction chambers;

a drive mechanism driven by the prime engine of the vehicle for operating said operation rod;

a resilient means to bias said diaphragm piston assembly to its original position against the operation torque from said drive mechanism by way of said operation rod, the improvement wherein said resilient means is assembled outside of said first and second chambers within said pump housing and comprises a coil spring interposed between a portion of said operation rod and a portion of the inner wall of said housing to bias said diaphragm piston assembly toward said second chamber from said first chamber and wherein said drive mechanism comprises an eccentric cam secured on a drive shaft driven by the prime engine, a drive arm swingably pivoted on a portion of said pump housing to engage with said eccentric cam at one end thereof, an interlocked arm swingably pivoted co-axially with said drive arm at one end thereof to be connected with said operation rod at the other end thereof and biasing means for constantly maintaining the engagement between the end of said drive arm and said eccentric cam, said drive and interlocked arms being interlocked to each other to effect the engine torque transmission from said eccentric cam and to disable the engine torque transmission in the return strokes of said operation rod and said first and second chambers are formed with a shape symmetrical to each other.

2. A diaphragm vacuum pump as set forth in claim 1, wherein said pump housing includes thereon a first and a second ports respectively connected with said first and second chambers by way of said first and second valve means and said communication means comprises a conduit connecting said first port with said second port.

3. In a diaphragm vacuum pump for a vehicle, comprising:

a pump housing mounted on a body portion of the vehicle and including thereon an inlet port connected to a pneumatically operated device and an exhaust port connected to the atmosphere;

a diaphragm piston assembly hermetically assembled within said housing to form a first and a second pressure reduction chamber respectively at the faces thereof, said first and second chambers being connected respectively with said inlet and exhaust port;

a first valve means assembled within said first chamber and including a first suction valve to pass air from said pneumatically operated device into said first chamber through said inlet port and a first exhaust valve to discharge said air into said second chamber;

a second valve means assembled within said second chamber and including a second suction valve to pass air exhausted from said first chamber into said second chamber by way of said first exhaust valve and a second exhaust valve to discharge said air externally, the suction and discharge of said second valve means being conducted in an opposite cycle to the suction and discharge of said first valve means;

a communication means for providing pneumatic communication between said first and second chambers by conducting the air exhausted by said first exhaust valve to said second suction valve;

an operation rod for reciprocating said diaphragm piston assemby for subsequently producing vacuum in said first and second pressure reduction chambers;

a drive mechanism driven by the prime engine of the vehicle for operating said operation rod;

a resilient means to bias said diaphragm piston assembly to its original position against the operation torque from said drive mechanism by way of said operation rod, the improvement wherein said resilient means is assembled outside of said first and second chambers within said pump housing and comprises a coil spring interposed between a partition wall forming said first chamber and a portion of said operation rod to bias said diaphragm piston assembly toward said first chamber and away from said second chamber, the drive mechanism comprising an eccentric cam secured on a drive shaft driven by the prime engine and a rocker arm swingably pivoted on a portion of said pump housing, one end of said rocker arm engaging detachably with said operation rod and the other end engaging with said eccentric cam and said first and second chambers are formed with a shape symmetrical to each other.

4. A diaphragm vacuum pump as set forth in claim 3, wherein said partition wall is provided with a sleeve made of synthetic resin for hermetically guiding the reciprocation of said operation rod.

* * * * *